US006572981B2

(12) United States Patent
Spitsberg

(10) Patent No.: US 6,572,981 B2
(45) Date of Patent: Jun. 3, 2003

(54) THERMAL BARRIER COATING SYSTEM WITH IMPROVED ALUMINIDE BOND COAT AND METHOD THEREFOR

(75) Inventor: Irene Theodor Spitsberg, Loveland, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/050,659

(22) Filed: Jan. 16, 2002

(65) Prior Publication Data

US 2002/0094447 A1 Jul. 18, 2002

Related U.S. Application Data

(62) Division of application No. 09/569,912, filed on May 11, 2000, now Pat. No. 6,340,500.

(51) Int. Cl.[7] ..... B32B 15/04; F03B 3/12

(52) U.S. Cl. ..... 428/629; 428/632; 428/650; 428/670; 428/699; 428/697; 428/701; 428/702; 428/469; 416/241 R

(58) Field of Search ..... 428/632, 633, 428/650, 655, 670, 680, 681, 679, 469, 472, 472.2, 697, 699, 701, 702; 416/241 R, 241 B

(56) References Cited

U.S. PATENT DOCUMENTS 4,414,249 A 11/1983 Ulion et al.
4,514,469 A * 4/1985 Loersch et al.
4,919,718 A 4/1990 Tiegs et al.
5,645,893 A 7/1997 Rickerby et al.
5,658,614 A * 8/1997 Basta et al.
5,972,424 A 10/1999 Draghi et al.
6,007,880 A 12/1999 Maloney
6,042,898 A 3/2000 Burns et al.
6,060,177 A 5/2000 Bornstein et al.
6,168,874 B1 * 1/2001 Gupta et al.
6,190,124 B1 2/2001 Freling et al.
6,221,512 B1 4/2001 Rickerby
6,403,165 B1 * 6/2002 Grylls et al.

* cited by examiner

*Primary Examiner*—Deborah Jones
*Assistant Examiner*—Jennifer McNeil
(74) *Attorney, Agent, or Firm*—David L. Narciso; Gary M. Hartman; Domenica N. S. Hartman

(57) ABSTRACT

A method for improving the thermal fatigue life of a thermal barrier coating (TBC) deposited on an aluminide bond coat through a process by which the surface morphology of the aluminide bond coat is modified to eliminate or at least reduce oxidation and oxidation-induced convolutions at the alumina-bond coat interface, as explained more fully below. The bond coat is deposited to have generally columnar grains and grain boundary ridges at its surface, and is then peened at an intensity sufficient to flatten at least some of the grain boundary ridges, but insufficient to cause recrystallization of the bond coat when later heated, such as during deposition of the thermal barrier coating. In so doing, the original surface texture of the bond coat is altered to be smoother where the grain boundaries meet the bond coat surface, thereby yielding a smoother bond coat surface where the critical alumina-bond coat interface will exist following oxidation of the bond coat.

10 Claims, 3 Drawing Sheets

THERMAL BARRIER COATING SYSTEM WITH IMPROVED ALUMINIDE BOND COAT AND METHOD THEREFOR

This is a division of patent application Ser. No. 09/569,912, filed May 11, 2000, now U.S. Pat. No. 6,340,500.

FIELD OF THE INVENTION

This invention relates to protective coating systems for components exposed to high temperatures, such as the hostile thermal environment of a gas turbine engine. More particularly, this invention is directed to a process for forming an improved aluminide bond coat of a thermal barrier coating (TBC) system, such as of the type used to protect gas turbine engine components.

BACKGROUND OF THE INVENTION

Higher operating temperatures for gas turbine engines are continuously sought in order to increase their efficiency. However, as operating temperatures increase, the high temperature durability of the components of the engine must correspondingly increase. Significant advances in high temperature capabilities have been achieved through the formulation of nickel and cobalt-base superalloys. Nonetheless, when used to form components of the turbine, combustor and augmentor sections of a gas turbine engine, such alloys alone are often susceptible to damage by oxidation and hot corrosion attack and may not retain adequate mechanical properties. For this reason, these components are often protected by an environmental and/or thermal-insulating coating, the latter of which is termed a thermal barrier coating (TBC) system. Ceramic materials and particularly yttria-stabilized zirconia (YSZ) are widely used as a thermal barrier coating (TBC), or topcoat, of TBC systems used on gas turbine engine components. TBC employed in the highest temperature regions of gas turbine engines is typically deposited by electron beam physical vapor deposition (EBPVD) techniques which yield a columnar grain structure that is able to expand and contract without causing damaging stresses that lead to spallation.

To be effective, TBC systems must have low thermal conductivity, strongly adhere to the article, and remain adherent throughout many heating and cooling cycles. The latter requirement is particularly demanding due to the different coefficients of thermal expansion between ceramic topcoat materials and the superalloy substrates they protect. To promote adhesion and extend the service life of a TBC system, an oxidation-resistant bond coat is often employed. Bond coats are typically in the form of overlay coatings such as MCrAlX (where M is iron, cobalt and/or nickel, and X is yttrium or another rare earth element), or diffusion aluminide coatings. A notable example of a diffusion aluminide bond coat contains platinum aluminide (Ni(Pt)Al) intermetallic. When a bond coat is applied, a zone of chemical interaction occurs within the surface of the superalloy substrate beneath the coating. This zone is typically referred to as a diffusion zone (DZ), and results from the interdiffusion between the coating and substrate. The diffusion zone beneath an overlay bond coat is typically much thinner than the diffusion zone beneath a diffusion bond coat.

During the deposition of the ceramic TBC and subsequent exposures to high temperatures, such as during engine operation, bond coats of the type described above form a tightly adherent alumina ($Al_2O_3$) layer or scale that adheres the TBC to the bond coat. The service life of a TBC system is typically limited by a spallation event brought on by thermal fatigue. Spallation of TBC deposited on MCrAlX bond coats generally occurs within the TBC near the TBC-to-alumina interface, while TBC deposited on diffusion aluminide bond coats typically spall at the alumina-to-bond coat interface or within the alumina layer itself. As a result, the alumina-to-bond coat interface is particularly critical for TBC systems that employ diffusion aluminide bond coats because spallation events often initiate at this interface.

In view of the above, it can be appreciated that bond coats have a considerable effect on the spallation resistance of the TBC, and therefore TBC system life. Consequently, improvements in TBC life have been continuously sought, often through modifications to the chemistries of the bond coat. The effect of the surface finish of MCrAlY bond coats has also been investigated, as evidenced by U.S. Pat. No. 4,414,249 to Ulion et al. The results of this investigation showed that the service life of a columnar TBC can be improved by polishing an MCrAlY bond coat before depositing the TBC. The benefit of improving the surface finish of an MCrAlY bond coat is believed to be that a smoother alumina layer grows, which in turn provides a more uniform surface upon which the columnar TBC is deposited. The initial portion of a columnar TBC consists of many small grains that appear to grow in a competitive fashion, by which more favorably oriented grains eventually dominate less favorably oriented grains. By polishing an MCrAlY bond coat, it is believed that Ulion et al. reduced the number of nucleated grains, thereby reducing growth competition and improving the quality of the TBC adjacent the alumina scale, i.e., in the very region that TBC spallation tends to occur on an MCrAlY bond coat. According to Ulion et al., an optional additional treatment is to dry glass bead peen an MCrAlY bond coat to densify any voids and improve the coating structure.

As noted above, TBC spallation initiates by a different mechanism on diffusion aluminide bond coats, and primarily along the alumina-bond coat interface. Accordingly, the toughness of the alumina and the alumina-bond coat interface are most important to TBC deposited on a diffusion aluminide bond coat. From this perspective, improving the surface finish of a diffusion aluminide bond coat by light peening or polishing would be expected to reduce TBC life, since sufficient surface roughness of the bond coat is desired to promote adhesion of the alumina to the bond coat, and to provide a tortuous path that inhibits crack propagation through the alumina and alumina-bond coat interface. As a result, conventional practice has been to grit blast the surface of diffusion aluminide bond coats to increase their roughness to about 50 microinches (about 1.25 micrometers) Ra or more before depositing the TBC.

BRIEF SUMMARY OF THE INVENTION

The present invention generally provides a method for improving the thermal fatigue life of a thermal barrier coating (TBC) deposited on a diffusion aluminide bond coat through a process by which the surface morphology of the aluminide bond coat is modified to eliminate or at least reduce oxidation and oxidation-induced convolutions at the alumina-bond coat interface, as explained more fully below. The bond coat can be a single-phase [(Ni,Pt)Al] or two-phase [$PtAl_2$+(Ni,Pt)Al] diffusion aluminide, though it is believed that overlay aluminide bond coats can also benefit from the teachings of this invention. The invention is particularly directed to aluminide bond coats deposited by methods that produce a generally columnar grain structure, in which grains extend through the additive layer of the bond coat, i.e., from the diffusion zone beneath the additive layer to the bond coat surface, such that grain boundaries are exposed at the bond coat surface. Two widely-used methods that produce bond coats of this character are vapor phase aluminizing (VPA) and chemical vapor deposition (CVD). The surface of a bond coat having columnar grains is characterized by surface irregularities, termed grain boundary ridges, that correspond to locations where grain boundaries meet the bond coat surface.

In the present invention, an aluminide bond coat having generally columnar grains and grain boundary ridges at its surface is peened at an intensity sufficient to flatten at least some of the grain boundary ridges, but insufficient to cause recrystallization of the bond coat when later heated, such as during deposition of the thermal barrier coating. In so doing, the original surface texture of the bond coat is altered to be smoother where the grain boundaries meet the bond coat surface, thereby yielding a smoother bond coat surface where the critical alumina-bond coat interface will exist following oxidation of the bond coat, such as during TBC deposition. Thereafter, the thermal barrier coating is deposited on the surface of the bond coat.

According to this invention, the original columnar grains of an as-deposited aluminide bond coat were found to be prone to accelerated oxidation at their grain boundaries, with oxidation initiating at the bond coat surface. Unexpectedly, flattened grain boundaries were shown to be much less prone to accelerated oxidation than the original grain boundaries. Surface modification in accordance with this invention also appears to significantly inhibit thermal grooving (the formation of valleys between adjacent grains), and thermal creep that has been determined to initiate and/or rapidly progress at grain boundaries exposed at the bond coat surface. A lower oxidation rate at the grain boundaries may eliminate a cause for the creation of stress concentration sites for enhanced localized creep and oxide crack initiation at the bond coat surface, which are believed to cause the alumina layer to convolute and fracture. Another possibility is that the modified bond coat grain configuration exhibits more stable surface tension conditions, which slow the thermal grooving effect. By eliminating or at least inhibiting the formation of sites where deformation of the alumina layer occurs, and thus where a fracture ultimately initiates and develops with thermal cycling, the spallation life of the TBC adhered by the bond coat is significantly increased.

Other objects and advantages of this invention will be better appreciated from the following detailed description.

DETAILED DESCRIPTION OF THE INVENTION

Figure 1:
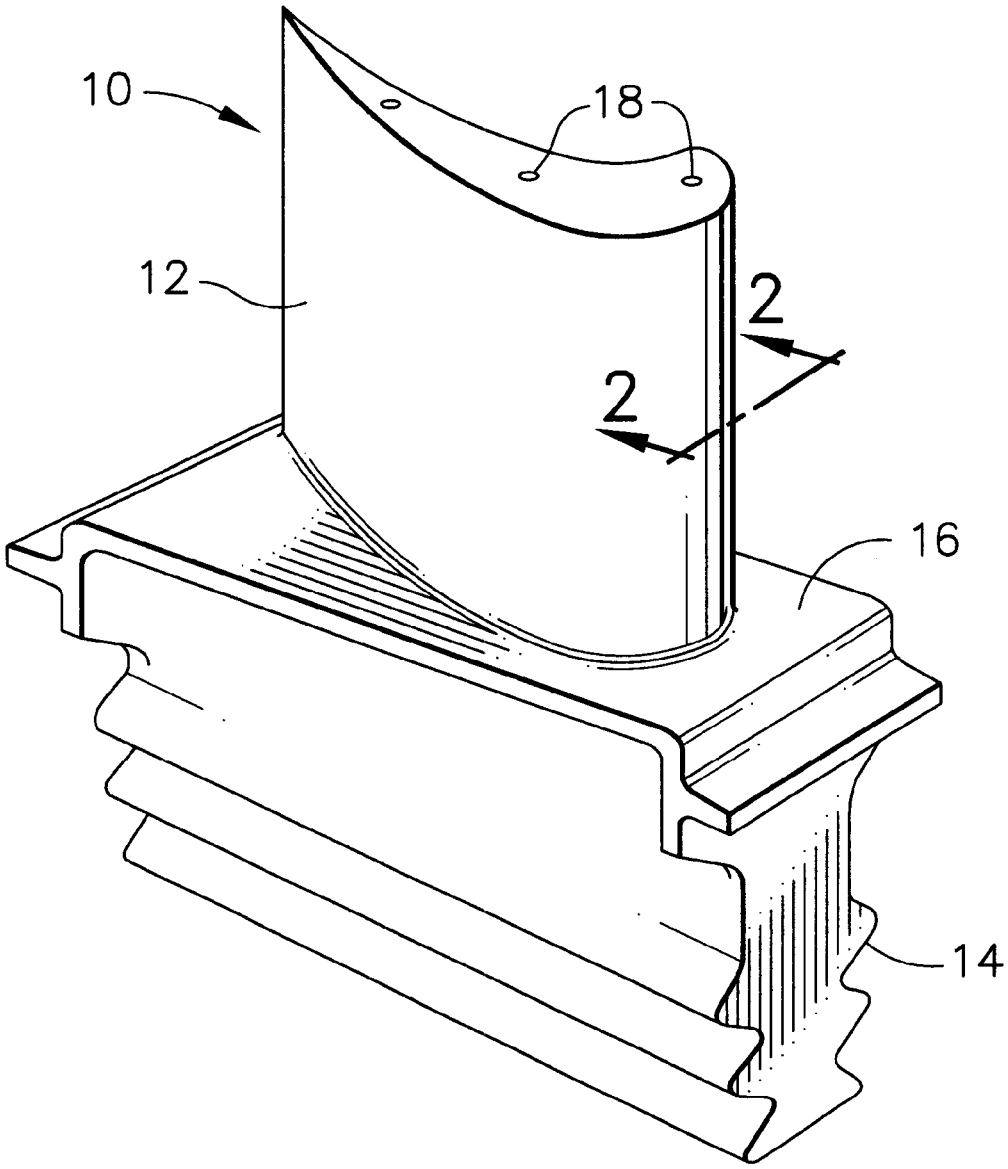
FIG. 1 is a perspective view of a high pressure turbine blade.

The present invention is generally applicable to components that operate within environments characterized by relatively high temperatures, and are therefore subjected to severe thermal stresses and thermal cycling. Notable examples of such components include the high and low pressure turbine nozzles and blades, shrouds, combustor liners and augmentor hardware of gas turbine engines. An example of a high pressure turbine blade 10 is shown in FIG. 1. The blade 10 generally includes an airfoil 12 against which hot combustion gases are directed during operation of the gas turbine engine, and whose surface is therefore subjected to severe attack by oxidation, corrosion and erosion. The airfoil 12 is anchored to a turbine disk (not shown) with a dovetail 14 formed on a root section 16 of the blade 10. Cooling holes 18 are present in the airfoil 12 through which bleed air is forced to transfer heat from the blade 10. While the advantages of this invention will be described with reference to the high pressure turbine blade 10 shown in FIG. 1, the teachings of this invention are generally applicable to any component on which a TBC system may be used to protect the component from its environment.

Figure 2:
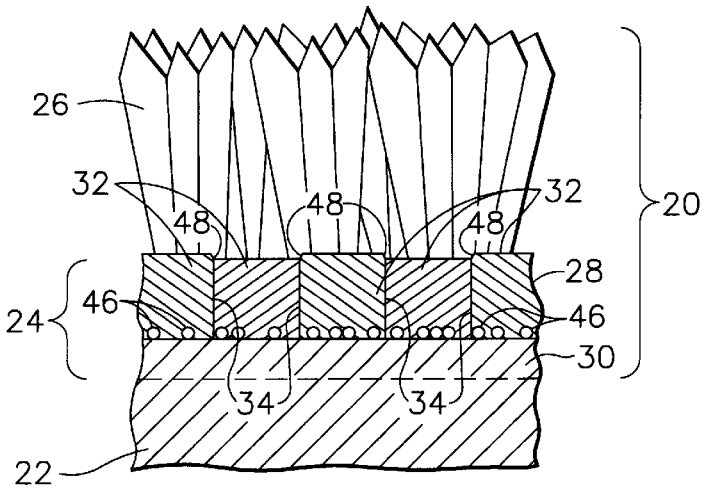
FIG. 2 (PRIOR ART)
FIG. 2 is a cross-sectional representation of a TBC system on a surface region of the blade of FIG. 1 along line 2—2.

Represented in FIG. 2 is a thermal barrier coating (TBC) system 20 of a type known in the art. As shown, the coating system 20 includes a bond coat 24 overlying a superalloy substrate 22, which is typically the base material of the blade 10. Suitable materials for the substrate 22 (and therefore the blade 10) include equiaxed, directionally-solidified and single-crystal nickel and cobalt-base superalloys. The bond coat 24 is shown as adhering a thermal-insulating ceramic layer 26, or TBC, to the substrate 22. As shown, the ceramic layer 26 has a strain-tolerant columnar grain structure achieved by depositing the ceramic layer 26 using physical vapor deposition techniques known in the art, particularly electron beam physical vapor deposition (EBPVD). A preferred material for the ceramic layer 26 is an yttria-stabilized zirconia (YSZ), a preferred composition being about 3 to about 8 weight percent yttria, though other ceramic materials could be used, such as yttria, nonstabilized zirconia, or zirconia stabilized by magnesia, ceria, scandia or other oxides. The ceramic layer 26 is deposited to a thickness that is sufficient to provide the required thermal protection for the underlying substrate 22 and blade 10, generally on the order of about 75 to about 300 micrometers.

The bond coat 24 is shown as being a diffusion aluminide of a type known in the art. The bond coat 24 is shown as being composed of an additive layer 28 overlying the substrate 22 and a diffusion zone 30 within the surface of the substrate 22. The diffusion zone (DZ) 30 contains various intermetallic and metastable phases that form during the coating reaction as a result of diffusional gradients and changes in elemental solubility in the local region of the substrate 22. The additive layer 28 is typically about 30 to 75 micrometers thick and contains the environmentally-resistant intermetallic phase MAl, where M is iron, nickel or cobalt, depending on the substrate material (mainly β(NiAl) if the substrate is Ni-base). The chemistry of the additive layer 28 is modified by the presence in the aluminum-containing composition of additional elements, such as chromium, silicon, platinum, rhodium, hafnium, yttrium and zirconium. For example, if platinum is deposited on the substrate 22 prior to aluminizing, the additive layer 28 consists of (Pt)NiAl-type intermetallic phases. The bond coat may be a single-phase [(Ni,Pt)Al] or two-phase [$PtAl_2$+(Ni,Pt)Al] diffusion aluminide.

The bond coat 24 is represented in FIG. 2 as being in an as-deposited condition, i.e., without any additional treatment provided by the present invention. In the as-deposited condition, the additive layer 28 is characterized by grains 32 that extend from the diffusion zone 30 to the surface of the bond coat 24, so that the grains 32 are generally columnar. As also represented, the grains 32 have grain boundaries 34 that intersect the surface of the bond coat 24 at an angle approximately normal to the surface. Those portions of the grain boundaries 34 parallel to the bond coat surface and bordering the diffusion zone 30 are shown as being decorated (pinned) with refractory phases 46 formed during deposition of the bond coat 24 as a result of diffusion of refractory elements from the superalloy substrate 22. Finally, the surface of the bond coat 24 is characterized by surface irregularities, termed grain boundary ridges 48, that correspond to the locations of the grain boundaries 34. The type of microstructure represented in FIG. 2 is typical of aluminide bond coats deposited by chemical vapor deposition (CVD) and vapor phase deposition, e.g., vapor phase aluminizing (VPA).

Figure 3:
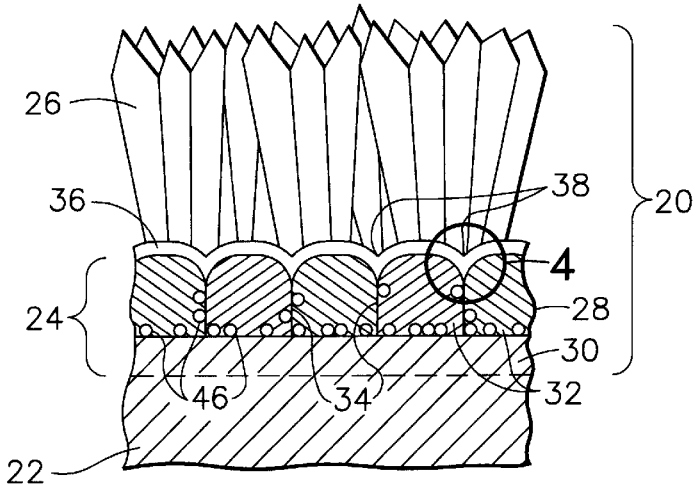
FIG. 3 (PRIOR ART)
FIGS. 3 through 5 show the progression of a spallation event of the TBC system of FIG. 2.

As depicted in FIG. 3, the aluminum-rich bond coat 24 naturally develops an aluminum oxide (alumina) scale 36 when exposed to an oxidizing atmosphere, such as during high temperature exposures in air. As portrayed in FIGS. 3 and 4, the oxide scale 36 has become convoluted, with valleys 38 present above a majority of the grain boundaries 34 at the bond coat surface. During engine service temperature exposure, the oxide scale 36 continues to grow beneath the permeable ceramic layer 26. Failure of the TBC system 20 during engine service exposure typically occurs by spallation of the ceramic layer 26 from cracks that initiate in the oxide scale 36 and then propagate into the interface between the bond coat 24 and oxide scale 36. Consequently, the strength of this interface, stresses within the interface plane, and changes with temperature exposure influence the life of the TBC system 20.

Figure 4:
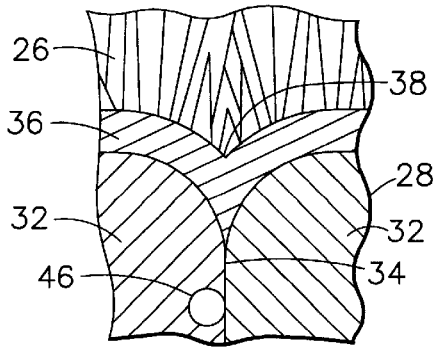
FIG. 4 (PRIOR ART)
Figure 5:
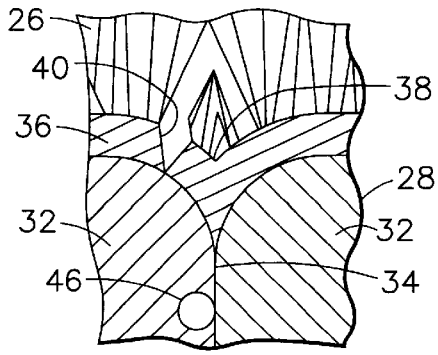
FIG. 5 (PRIOR ART)

During an investigation leading to this invention, superalloy specimens were coated with a TBC system of the type shown in FIG. 2. The superalloys were ReneN5 with a nominal composition in weight percent of Ni-7.5Co-7.0Cr-6.5Ta-6.2Al-5.0W-3.0Re-1.5Mo-0.15Hf-0.05C-0.004B-0.01Y, and Rene R142 with a nominal composition in weight percent of Ni-12Co-6.8Cr-6.35Ta-6.15Al-4.9W-2.8Re-1.5Mo-1.5Hf-0.12C-0.015B. The ceramic topcoat was YSZ deposited by EBPVD, while the bond coats were single and two-phase PtAl deposited by VPA or CVD. The specimens were furnace cycle tested (FCT) at 2075° F. (about 1135° C.) at one-hour cycles to spallation, and then examined for appearance of the fracture mode that caused spallation. Detailed observations made with these specimens suggested that spallation was brought on by a mechanism that involved convolution of the oxide scale 36, as discussed above in reference to FIGS. 3 through 5. The convolutions were observed to typically initiate at the grain boundaries 34, and to further develop with oxide growth. Distinct valleys 38 formed as a result of the scale convolution eventually reached a critical depth/width ratio, at which point the scale 36 was bent at nearly a 90 degree angle (FIG. 4). As shown in FIG. 5, a crack 40 eventually formed in the scale 36 and typically propagated into the bond coat/oxide scale interface.

From this investigation, it was concluded that TBC spallation on a conventional diffusion aluminide bond coat occurred as a result of cracks developing at steep convolutions in the oxide scale, followed by multiple cracks propagating and linking together to cause an area of TBC to spall. It was also concluded that advanced convolutions which led to oxide cracking were associated with the bond coat grain boundaries. One possible reason for this observation was the concentration of stresses at the grain boundaries at the bond coat surface during thermal cycling due to the ridges 48 of the grain boundaries 34 seen in FIG. 2. Also potential factors include some type of modification of the surface tension force triangle at the grain boundary ridges 48, which results in the thermal grooving effect that forms the valleys 38 between the coating grain boundaries 34. The size of the valleys 38 was observed to increase during thermal cycling, presumably due to stress concentration and enhanced grain boundary creep.

A process for modifying the surface morphology of an aluminide bond coat was then investigated for the purpose of evaluating the effect on TBC life. The investigation was directed to achieving and evaluating the effect of modifying bond coat surface stresses localized at grain boundaries through altering the surface grain morphology. It was postulated that reducing the grain boundary ridges 48 could be beneficial to eliminate high stress concentrations in the bond coat surface.

Trial #1

In a first trial, a group of specimens were coated with TBC systems that included VPA two-phase PtAl diffusion bond coats, and then evaluated by furnace cycle testing (FCT) at about 2075° F. (about 1135° C.) with one-hour cycles. All of the specimens underwent conventional grit blasting (80 alumina grit at 60 psi), while a limited number of the specimens were subjected to various intensity levels of zirconia bead peening, including intensity levels 6A to 8A, which is a range above that achievable with the dry glass bead peening (up to 6A) taught by U.S. Pat. No. 4,414,249 to Ulion et al. Coverage was not a specifically controlled parameter of the peening process.

Some of the peened specimens achieved a FCT life of about 600 to 780 cycles, as compared to about 480 to 500 cycles for the baseline specimens (grit blasted only). A detailed examination of the best peened specimens revealed that the TBC spallation mode in these specimens was different from the typical mode shown in FIGS. 2 through 5. Specifically, TBC spallation occurred as a result of a relative smooth oxide delamination from the bond coat, with grain boundary convolutions rarely being observed. From this trial, it was concluded that an aluminide bond coat whose surface had been modified by peening could result in significantly improved spallation resistance (about 1.5 to 2 times improved FCT life) as compared to the aluminide bond coats that had been limited to surface roughening by conventional grit blasting. The difference in the spallation mode between specimens (smooth delamination vs. oxide convolution) was attributed to the variability in peening coverage (which likely allowed for less than 100% coverage), and that coverage was an important parameter of the peening process.

Trial #2

In a second trial, the surfaces of six Ni-based superalloy specimens coated by VPA with single-phase PtAl bond coats were shot peened with zirconia or stainless steel shot with an intensity of about 6A to about 12A and a coverage of at least 100%. Some of the specimens were peened at intensities of about 6A to 10A, and underwent heat treatment at about 1925° F. (about 1050° C.) for two hours. Other specimens were peened at 8A to 12A and underwent heat treatment at about 2050° F. (about 1120° C.) for about two hours. The heat treatment at the higher temperature caused recrystallization throughout the additive layers of the bond coats, while the lower-temperature treatment did not. All of the specimens were then coated with 7% YSZ deposited by EBPVD, after which some of the specimens that underwent the 1925° F. heat treatment and all of the specimens that underwent the 2050° F. heat treatment were tested by FCT at about 2125° F. (about 1160° C.) with one-hour cycles.

Figure 6:
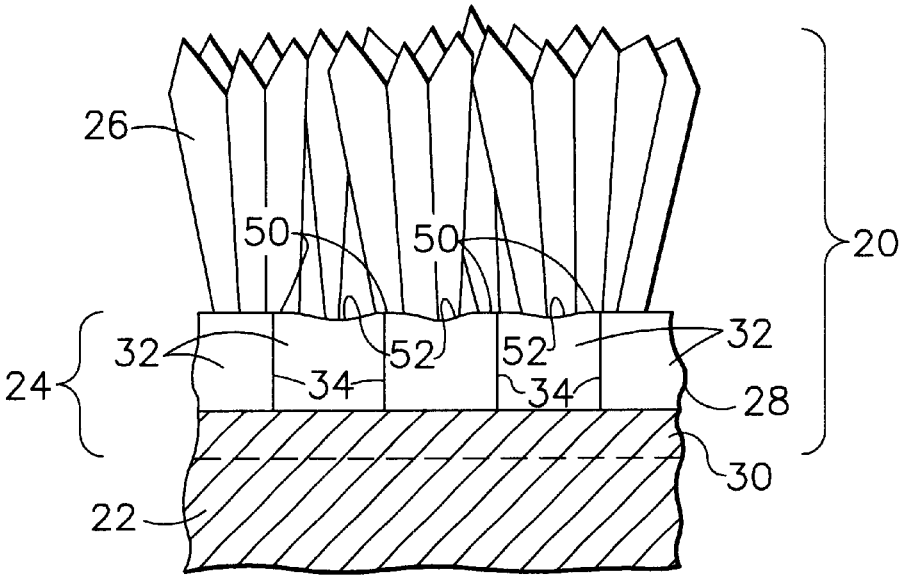
FIG. 6 is a cross-sectional representation of a TBC system with a diffusion aluminide bond coat whose surface has been modified to eliminate grain boundary ridges in accordance with this invention.

The TBC life of the specimens that did not undergo recrystallization was about 420 to about 520 cycles, while the TBC life of the recrystallized specimens was about 300 to 320 cycles. Historically, specimens of this type spall after an average of about 230 cycles. The surface morphology of specimens that did not undergo recrystallization is represented in FIG. 6, which portrays the grain boundary ridges 48 of FIG. 2 as being replaced by flattened grain boundary surfaces 50. The surfaces of these bond coats were not entirely flat, allowing for valleys and other minor surface irregularities 52 between flattened grain boundary surfaces 50.

Figure 7:
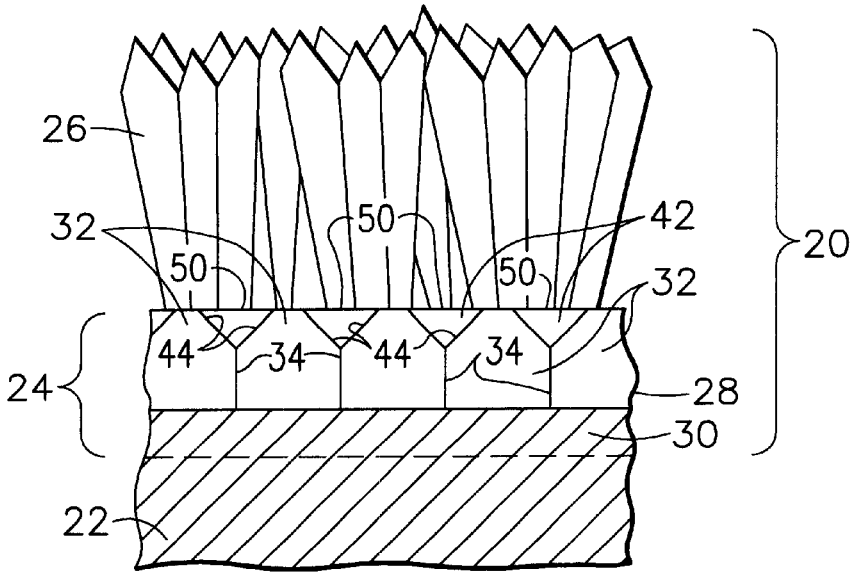
FIG. 7 is a cross-sectional representation of a TBC system with a diffusion aluminide bond coat in accordance with this invention, in which triangular-shaped grains are present beneath flattened grain boundaries at the bond coat surface.

The remainder of the YSZ-coated specimens that had undergone the 1925° F./two-hour heat treatment were exposed to twenty one-hour cycles at 2125° F. (about 1160° C.), and their cross-sections metallographically examined to observe their microstructure evolution. These specimens were typically found to have triangular-shaped grains 42 beneath the flattened grain boundary surfaces 50, as depicted in FIG. 7. Significantly, the grain boundaries 44 of these grains 42 did not appear susceptible to oxide convolution and thermal grooving.

From these results, it was concluded that the ability to achieve improvements in TBC life with single-phase aluminide bond coats is sensitive to the peening and heat treatment parameters. Shot peening of single-phase aluminide bond coats that results in grain recrystallization improves TBC life, but shot-peened single-phase aluminide bond coats exhibit far longer TBC lives if they do not undergo recrystallization during heat treatment.

The incidence of recrystallization was concluded to be dependent on a sufficiently high peening intensity and/or a sufficiently high heat treatment temperature. The difference in TBC lives between single-phase aluminide coatings that were and were not recrystallized was believed to be attributable to the surface of the coating being reformed during the recrystallization process, producing small steps between the grain boundaries at the coating surface. These steps were believed to be sufficient to cause oxide convolution at the grain boundaries during thermal cycling.

This trial evidenced that single-phase PtAl bond coats benefit from peening without recrystallization, and more particularly that the surface morphology of a single-phase aluminide bond coat benefits from a peening intensity of between 6A and 10A and a peening coverage of at least 100%. While not wishing to be limited to any particular theory, it is believed that recrystallization is detrimental to single-phase aluminide bond coats because the surface modification achieved by peening is lost through recrystallization, during which recrystallized grains generate a new surface structure that is independent of the original surface structure. Consequently, a proper combination of peening intensity and heat treatment temperature is critical to single-phase aluminide bond coats.

Trial #3

In a third trial, the role of heat treatment for different aluminide coating compositions was investigated. A number of superalloy specimens were coated with single-phase PtAl diffusion bond coats that were shot peened with ceramic shot prior to depositing the TBC. The deposition method, coating hardness, peening intensity and coverage, and heat treatment are indicated in the following table.

| Group | Deposition Method | Hardness (HRc) | Peening Int. & Cov. | Heat Treatment |
|---|---|---|---|---|
| A | CVD | 45 HRc | 8A @ 1000% | NONE |
| B | CVD | 45 HRc | 8A @ 1000% | 1050° C./2 hrs. |
| C | VPA | 55–60 HRc | 10A @ 100% +6A @ 500% | 1050° C./2 hrs. |
| D | VPA | 55–60 HRC | 10A @ 100% +6A @ 500% | NONE |

The aluminum content of the specimens deposited by CVD (chemical vapor deposition) was about 18 to 20 weight percent, while the aluminum content of the specimens deposited by VPA (vapor phase aluminizing) was above 20 weight percent. None of the specimens underwent recrystallization during heat treatment as a result of using a sufficiently low heat treatment temperature for the peening intensities employed. In all specimens, the grain boundary geometry at the bond coat surface was modified. Peening caused their grain boundary geometry to become generally flatter as a result of reducing and flattening the surface grain boundary ridges characteristic of aluminide bond coats deposited by CVD and VPA.

All of the specimens were then coated with 7% YSZ by EBPVD and tested by FCT at about 2125° F. (about 1160° C.) with one-hour cycles. The resulting FCT lives were: 760 cycles for the Group A specimen, 720 to 760 cycles for the Group B specimens, 420 to 520 cycles for the Group C specimens, and 220 to 420 cycles for the Group D specimens. Again, the historical average FCT life for TBC systems having single-phase PtAl bond coats is about 230 cycles. Accordingly, the Group A and B specimens exhibited a TBC life of about two to three times the baseline average, and the Group C specimens exhibited a TBC life of about two times the baseline average. In contrast, the Group D specimens exhibited a large scatter in FCT life, with an average of 260 cycles being only modestly better than the baseline average.

From the above, heat treatment was concluded to be necessary for harder single-phase aluminide coatings, suggesting that surface stresses may prevent the formation of an adherent oxide scale. For single-phase aluminide bond coats with a hardness of less than about 50 HRc, heat treatment can be beneficial at temperatures less than 2000° F. (about 1090° C.), preferably less than 1975° F. (about 1080° C.), with a suitable treatment being about two hours at about 1925° F. (about 1050° C.). In contrast, for single-phase aluminide bond coats with a hardness above about 50 HRc, heat treatment at a temperature of about 1700° F. to about 1975° F. (about 925° C. to about 1080° C.) appears necessary, with a suitable treatment being about two hours at about 1925° F. (about 1050° C.). The parameters used in this trial also appeared to confirm that the surface morphology of a single-phase aluminide bond coat benefits from a peening intensity of between 6A and 10A and a peening coverage of at least 100%, with a minimum coverage of about 500% appearing to be necessary, when intensities of 6A to 8A is used.

Trial #4

In a final investigation, a study was undertaken of grain structure modification through peening. In this trial, the surfaces of Ni-based superalloy specimens coated by VPA and CVA with two-phase PtAl bond coats were shot peened with stainless steel shot with an intensity of about 6A to about 12A and a coverage of at least 100%. Some of the specimens underwent heat treatment at about 1700° F.

(about 925° C.) to about 1975° F. (about 1080° C.) for one-half to three hours. Other specimens underwent heat treatment at about 2000° F. to 2050° F. (about 1090° C. to about 1120° C.) for one to three hours. The heat treatments at 1975° F. and 2000–2050° F. caused partial or full recrystallization of the bond coat additive layers, while the lower-temperature treatment did not. However, the recrystallization process that occurred in these two-phase aluminide coatings differed from the recrystallization that occurred in the single-phase aluminide coatings of Trials 2 and 3. Specifically, fine equiaxial grains were typically formed throughout the entire coating during heat treatment.

Limited thermal cycle testing suggested that full recrystallization of two-phase aluminide bond coats might be beneficial to TBC life, in contrast to the detrimental effect seen for single-phase aluminide bond coats (e.g., those of Trials 2 and 3). Based on this trial, it was concluded that the surface morphology of a two-phase aluminide bond coat may benefit from a peening intensity of between 6A and 8A, a peening coverage of at least 100%, and an optional heat treatment at a temperature of about 1700° F. to 2050° F. (about 925° C. to about 1120° C.).

In view of the above, the present invention provides for the peening of aluminide bond coats to yield a modified surface morphology capable of improving the service life of a TBC adhered to the bond coat. The improved TBC life is believed to be the result of reducing the height of surface ridges associated with grain boundaries formed during deposition by VPA and CVD. Based on test results, shot peening with an intensity of at least 6A and up to a maximum of 12A is believed to be necessary, along with a surface coverage of about 100 to 1500%, preferably about 500 to 1500%. More particularly, a shot peening intensity of about 6A to 8A is believed acceptable for two-phase aluminide bond coats, while a shot peening intensity of about 6A to 10A is preferred for single-phase aluminide bond coats. The maximum intensities for these ranges are limited to avoid damage to the component surface and alloy properties beneath the bond coat. While shot peening is the preferred method for modifying the bond coat surface as it can be well controlled and characterized in terms of stresses distribution, it is foreseeable that other methods could be used, such as tumbling and vibrolapping.

The present invention also evidenced that heat treatment is necessary for harder single-phase aluminide coatings, possibly as a result of surface stresses inhibiting the formation of an adherent oxide scale. In contrast, heat treatment is optional for relatively softer single-phase aluminide bond coats. In either case, it appears that the avoidance of recrystallization in a single-phase aluminide bond coat is important to realize the full benefits of the peening treatment. However, the subsequent development of triangular grains (42 in FIG. 7) beneath the modified (flattened) grain boundaries (50 in FIGS. 6 and 7) during thermal cycling does not appear to be detrimental to single-phase aluminide bond coats. As such, no detriment is expected from the subsequent development of triangular grains in a single-phase aluminide bond coat during the thermal cycling associated with engine service. Finally, recrystallization does not appear to be detrimental to two-phase aluminide bond coats.

While the invention has been described in terms of a preferred embodiment, it is apparent that other forms could be adopted by one skilled in the art. Therefore, the scope of the invention is to be limited only by the following claims.

What is claimed is:

1. A thermal barrier coating system on a surface of a component, the coating system comprising a thermal barrier coating adhered to a diffusion aluminide bond coat on the surface of the component with an aluminum oxide scale, the bond coat being formed by a diffusion coating reaction to have an additive layer on the surface of the component, a diffusion zone in a surface region of the component and containing intermetallic and metastable phases that form during the diffusion coating reaction, and columnar grains that extend substantially through the additive layer, the grains having grain boundaries exposed at the surface of the bond coat, the grain boundaries having peened, flattened grain boundary surfaces at the surface of the bond coat, the bond coat being substantially free of recrystallized grains.

2. A thermal barrier coating system according to claim 1, wherein the bond coat is a single-phase aluminide.

3. A thermal barrier coating system according to claim 2, wherein the bond coat is a platinum aluminide.

4. A thermal barrier coating system according to claim 2, wherein the bond coat comprises triangular grains beneath flattened grain boundary surfaces.

5. A thermal barrier coating system according to claim 1, wherein the bond coat is a two-phase aluminide.

6. A thermal barrier coating system according to claim 5, wherein the bond coat is a platinum aluminide.

7. A thermal barrier coating system according to claim 1, wherein the thermal barrier coating has a columnar grain structure.

8. A thermal barrier coating system on a surface of a superalloy component, the coating system comprising a thermal barrier coating adhered to a single-phase diffusion aluminide bond coat on the surface of the component with an aluminum oxide scale, the bond coat being formed by a diffusion coating reaction to have an additive layer on the surface of the component, a diffusion zone in a surface region of the component and containing intermetallic and metastable phases that form during the diffusion coating reaction, and columnar grains that extend substantially through the additive layer, the grains having grain boundaries exposed at the surface of the bond coat, the grain boundaries having peened, flattened grain boundary surfaces at the surface of the bond coat with valleys and surface irregularities between adjacent grain boundaries surfaces, the bond coat being substantially free of recrystallized grains.

9. A thermal barrier coating system according to claim 8, wherein the bond coat is a platinum aluminide.

10. A thermal barrier coating system according to claim 8, wherein the bond coat comprises triangular grains beneath the flattened grain boundary surfaces.

* * * * *